US008581159B2

(12) United States Patent
Ernst et al.

(10) Patent No.: US 8,581,159 B2
(45) Date of Patent: Nov. 12, 2013

(54) CONTROL METHOD FOR A COOKTOP AND COOKTOP FOR CARRYING OUT SAID METHOD

(75) Inventors: Holger Ernst, Bielefeld (DE); Uwe Femmer, Guetersloh (DE); Sonja Heitmann, Guetersloh (DE); Thomas Kruempelmann, Guetersloh (DE)

(73) Assignee: Miele & Cie. KG, Guetersloh (DE)

( * ) Notice: Subject to any disclaimer, the term of this patent is extended or adjusted under 35 U.S.C. 154(b) by 819 days.

(21) Appl. No.: 12/663,080

(22) PCT Filed: Jun. 4, 2008

(86) PCT No.: PCT/EP2008/004434

§ 371 (c)(1), (2), (4) Date: Dec. 4, 2009

(87) PCT Pub. No.: WO2008/148529

PCT Pub. Date: Dec. 11, 2008

(65) Prior Publication Data

US 2010/0181302 A1 Jul. 22, 2010

(30) Foreign Application Priority Data

Jun. 5, 2007 (DE) ..... 10 2007 026 461
Jun. 5, 2007 (DE) ..... 10 2007 026 462

(51) Int. Cl.
*H05B 6/06* (2006.01)
*H05B 6/12* (2006.01)

(52) U.S. Cl.
USPC ..... 219/622; 219/620; 219/621; 219/623; 219/624; 219/625; 219/626; 219/627

(58) Field of Classification Search
USPC ..... 219/620–627
See application file for complete search history.

(56) References Cited

U.S. PATENT DOCUMENTS 3,719,789 A 3/1973 Harnden, Jr.
5,460,451 A * 10/1995 Wadman ..... 374/126

(Continued)

FOREIGN PATENT DOCUMENTS

DE 102004002058 B3 9/2005
EP 1006756 A1 6/2000

(Continued)

OTHER PUBLICATIONS

International Search Report issued during the prosecution of PCT/EDP2008/004434; mailed Nov. 3, 2008; 6 pages.

*Primary Examiner* — Matthew W Such
*Assistant Examiner* — Robert Carpenter
(74) *Attorney, Agent, or Firm* — Leydig, Voit & Mayer, Ltd.

(57) ABSTRACT

A method and cooktop include a cooktop panel, a cooking zone, and an induction heating device disposed below the cooktop panel. First, second and third heat sensor units are disposed beneath the cooktop panel in a region of a measuring spot. The first heat sensor unit is configured to measure heat flow from substantially only the cooktop panel. The second and third heat sensor units are configured to measure heat flow from the cooktop panel and a cooking utensil disposed thereon. A light source is provided for measuring an emissivity of the bottom of the cooking utensil. An auxiliary heater heats the region of the measuring spot. An electrical control system calculates a ratio from signals of the second and third heat sensor units and determines an actual temperature of the bottom of the cooking utensil from the ratio by using a temperature of a lower surface of the cooktop panel measured by the first sensor unit and a value of the emissivity of the cooking utensil bottom.

13 Claims, 3 Drawing Sheets

(56) References Cited

U.S. PATENT DOCUMENTS

| | | | | |
|---|---|---|---|---|
| 6,118,105 | A | 9/2000 | Berkcan et al. | |
| 6,169,486 | B1 | 1/2001 | Berkcan et al. | |
| 6,225,607 | B1 | 5/2001 | Has et al. | |
| 6,375,350 | B1 | 4/2002 | Stein | |
| 2005/0115958 | A1* | 6/2005 | Hoh et al. | 219/620 |

FOREIGN PATENT DOCUMENTS

| | | | |
|---|---|---|---|
| EP | 1180669 | A1 | 2/2002 |
| EP | 1615469 | A2 | 1/2006 |
| WO | 2005/069693 | A1 | 7/2005 |

* cited by examiner

CONTROL METHOD FOR A COOKTOP AND COOKTOP FOR CARRYING OUT SAID METHOD

CROSS REFERENCE TO RELATED APPLICATIONS

This application is a U.S. National Phase application under 35 U.S.C. §371 of International Application No. PCT/EP2008/004434, filed on Jun. 4, 2008, and claims benefit to German Patent Application No. DE 10 2007 026 462.5, filed on Jun. 5, 2007 and German Patent Application No. DE 10 2007 026 461.7 filed Jun. 5, 2007. The International Application was published in German on Dec. 11, 2008 as WO 2008/148529 A2 under PCT Article 21 (2).

FIELD

The present invention relates to a method for controlling a cooktop including a cooktop panel, in particular one made of glass-ceramic, further including at least one cooking zone which can be heated by an induction heating device that is located beneath the cooktop panel when the cooktop is in the installed position, further including an electrical control system provided with a processing unit and a memory, and further including heat sensor units located beneath the cooktop panel. The present invention further relates to a cooktop for carrying out the method.

BACKGROUND

A method for controlling a cooktop including a cooking zone which can be heated by an induction heating device is described in German Patent DE 10 2004 002 058 B3. The described method controls a cooking process on a cooktop including a cooktop panel which is made, in particular, of glass-ceramic and which has a material thickness s defined by a flat upper surface and a flat lower surface in a direction perpendicular to the main directions of extension of the cooktop panel, further including at least one cooking zone that can be heated by a heating device located beneath the cooktop panel when the cooktop is in the installed position, further including an electrical control system for controlling the heat output of the heating device, and further including heat sensor units located beneath the cooktop panel.

In order to enable the heat output of the heating device to be controlled taking into account the influence of a cooking utensil placed on the cooking zone, the method from DE 10 2004 002 058 B3 proposes that the first heat sensor unit measure substantially a heat flow emanating downward only from the cooktop panel in the area of the cooking zone, and that the second and third heat sensor units measure substantially a heat flow emanating downward, in the area of the cooking zone, from the cooktop panel and a cooking utensil placed thereon. The heat sensor units are located beneath the lower surface of the cooktop panel in the region of a limited measuring spot which is delimited from the surroundings by a measurement channel or hollow waveguide, for example. The temperature $T_{cooking\ utensil}$ of the cooking utensil bottom is determined based on the output signals of the heat sensor units and evaluated for purposes of controlling the heat output of the heating device in the electrical control system provided with the processing unit and the memory.

According to this method, it is not absolutely necessary to know the emissivity $\epsilon_{cooking\ utensil}$ of the bottom of the cooking utensil. However, taking the emissivity of the bottom of the cooking utensil into account would result in a more accurate measurement result of the temperature $T_{cooking\ utensil}$ of the cooking utensil bottom. Therefore, German Patent DE 10 2004 002 058 B3 describes determining $\epsilon_{cooking\ utensil}$ by performing a reflection measurement. This method results in more accurate measurement results for the determination of the temperature of the cooking utensil bottom if the transmission coefficient of the cooktop panel is known and remains constant. However, during normal use of the cooktop panel, the transmission coefficient of the cooktop panel may vary because of accumulation of dirt. A dirty cooktop panel has reduced transmission, which leads to errors in the determination of $\epsilon_{cooking\ utensil}$. In addition, this corrupts the results obtained in the measurement of the temperature of the cooking utensil bottom.

SUMMARY

An aspect of the present invention is to provide a method for controlling a cooktop that will allow the temperature of the cooking utensil to be determined accurately, taking into account the influence of the emissivity of the bottom of the cooking utensil and the transmittance of the cooktop panel, and will further allow said temperature to be evaluated for the control of the cooktop with respect to the output of the induction heating device.

In an embodiment, the present invention provides a method for controlling a cooktop having a cooktop panel. The method includes providing the cooktop with at least one cooking zone that is heatable by an induction heating device disposed below the cooktop panel when the cooktop is in an installed position and providing an electrical control system including a processing unit and a memory. First, second and third heat sensor units are provided beneath the cooktop panel in a region of a measuring spot, the first heat sensor unit being configured to measure heat flow emanating downward from substantially only the cooktop panel in an area of the at least one cooking zone, the second and third heat sensor units being configured to measure heat flow emanating downward in an area of the cooking zone from the cooktop panel and a cooking utensil disposed on the cooktop panel. A reflection measurement is performed to determine an emissivity $\epsilon_{cooking\ utensil}$ of a bottom of the cooking utensil using at least one emissivity heat sensor and a light source. The cooking utensil is heated using the induction heating device during a heat-up phase. The cooktop panel is heated in an area of the cooking zone to a predetermined desired temperature $T_{cooking\ utensil}$ during the heat-up phase. A value for the emissivity $\epsilon_{cooking\ utensil}$ of the bottom of the cooking utensil is stored in the memory of the electrical control system. The region of the measuring spot is heated using an auxiliary heater to a temperature $T_{desired}$, $T_{desired}$ being at least approximately equal to the predetermined desired temperature $T_{cooking\ utensil}$. Upon reaching $T_{desired}$ at the measuring spot and $T_{cooking\ utensil}$ at the cooking zone in a cooking phase following the heat-up phase, a ratio is calculated from output signals of the second and third heat sensor units using the electrical control system. An actual temperature of the bottom of the cooking utensil is determined from the ratio by using a temperature of a lower surface of the cooktop panel $T_{cooktop\ panel}$ measured by the first sensor unit and the value of the emissivity $\epsilon_{cooking\ utensil}$ of the bottom of the cooking utensil. The induction heating device is controlled as a function of the actual temperature of the bottom of the cooking utensil.

In another embodiment, the present invention provides a cooktop including a cooktop panel having a material thickness in a direction perpendicular to main directions of extension of the cooktop panel, the material thickness being defined by a flat upper surface and a flat lower surface of the cooktop panel. The cooktop also includes at least one cooking zone and an induction heating device disposed below the cooktop panel and in an installed position of the cooktop panel is operable to heat the at least one cooking zone. First, second and third heat sensor units are disposed beneath the cooktop panel in a region of a measuring spot, the first heat sensor unit being configured to measure heat flow emanating downward from substantially only the cooktop panel in an area of the at least one cooking zone, the second and third heat sensor units being configured to measure heat flow emanating downward in an area of the cooking zone from the cooktop panel and a cooking utensil disposed on the cooktop panel. A light source is provided that is operable, in combination with at least one emissivity heat sensor, to measure an emissivity $\epsilon_{cooking\ utensil}$ of a bottom of a cooking utensil disposed on the cooktop panel. An auxiliary heater is included that is operable to heat a region of the measuring spot. An electrical control system including a processing unit and a memory is configured to calculate a ratio from output signals of the second and third heat sensor units during a cooking phase, determine an actual temperature of the bottom of the cooking utensil from the ratio by using a temperature of a lower surface of the cooktop panel $T_{cooktop\ panel}$ measured by the first sensor unit and a value, stored in the memory, of the emissivity $\epsilon_{cooking\ utensil}$ of the bottom of the cooking utensil, control the induction heating device as a function of the actual temperature of the bottom of the cooking utensil, and control a heat output of the auxiliary heater

BRIEF DESCRIPTION OF THE DRAWINGS

An exemplary embodiment of the present invention will be described in more detail below and is schematically shown in the drawings, in which.

DETAILED DESCRIPTION

Figure 1:
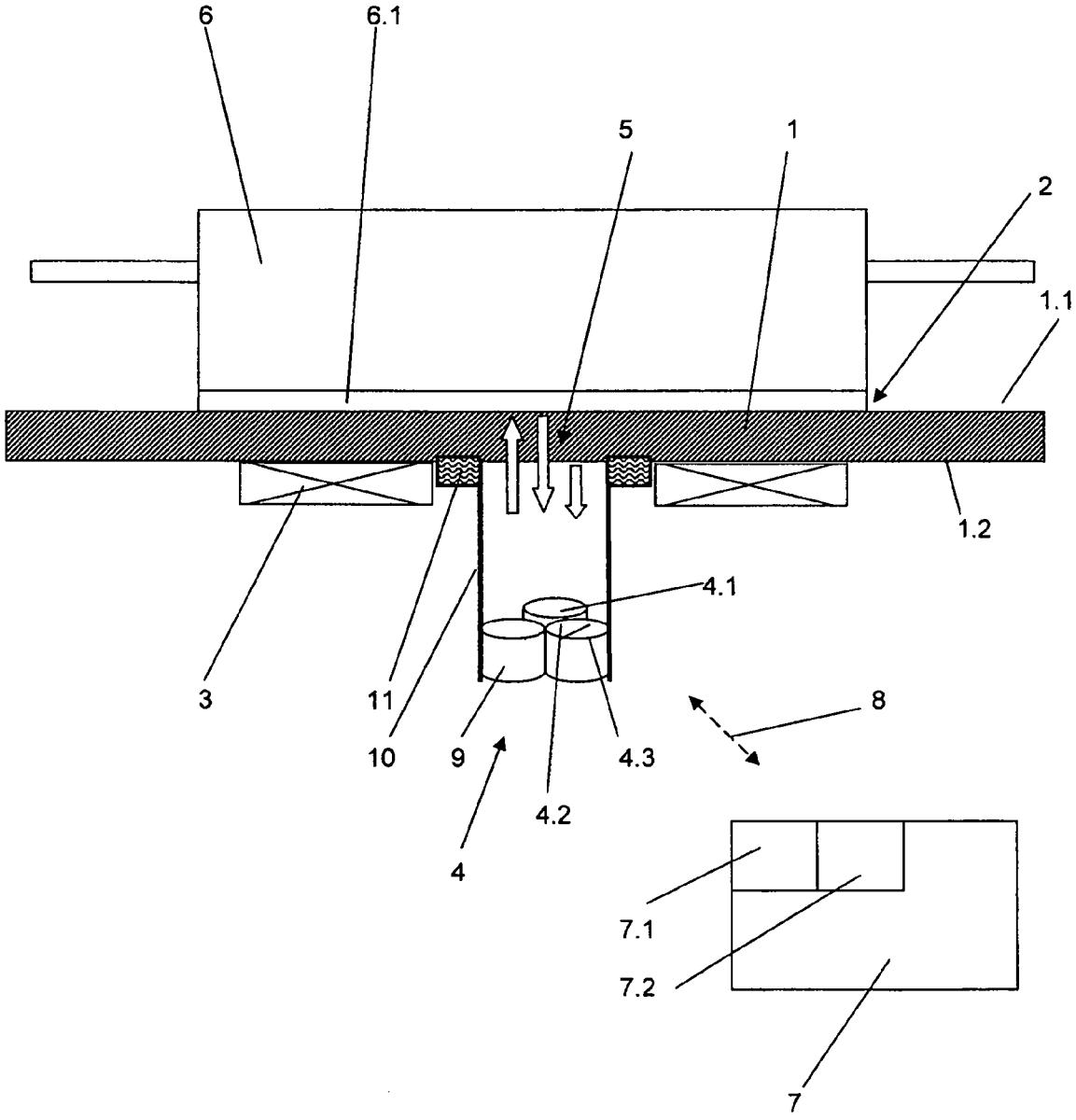
FIG. 1 is a side view of an embodiment of a cooktop according to the present invention.

In an embodiment, the present invention relates to a method for controlling a cooktop including a cooktop panel, in particular one made of glass-ceramic, further including at least one cooking zone which can be heated by an induction heating device that is located beneath the cooktop panel when the cooktop is in the installed position, further including an electrical control system provided with a processing unit and a memory, and further including heat sensor units located beneath the cooktop panel in the region of a measuring spot which is delimited from the surroundings, the first heat sensor unit measuring substantially a heat flow emanating downward only from the cooktop panel in the area of the cooking zone, and the second and third heat sensor units measuring substantially a heat flow emanating downward, in the area of the cooking zone, from the cooktop panel and a cooking utensil placed thereon, and further including a light source for performing a reflection measurement via at least one heat sensor to determine the emissivity $\epsilon_{cooking\ utensil}$ of the bottom of a cooking utensil placed on the cooktop panel. The present invention further relates to a cooktop for carrying out the method.

The present invention can provide improved accuracy in the control of a cooking process on a cooktop. This is achieved by improved accuracy in the determination of the actual instantaneous temperature $T_{cooking\ utensil}$ of the cooking utensil bottom, and thus of the cooking utensil, taking into account the influence of the emissivity of the cooking utensil and the transmission coefficient, which is changed by dirt accumulation on the cooktop panel.

In accordance with an embodiment of the present invention, the emissivity of the cooking utensil can be determined by measuring the reflection of a beam of light emitted from a light source and directed toward the bottom of the cooking utensil, said measurement being made by the second heat sensor unit. In principle, it is also possible to use an additional heat sensor unit for this purpose. It is also possible for the emissivity $\epsilon_{cooking\ utensil}$ of the cooking utensil; i.e., of the bottom of the cooking utensil, to be specified, in which case it may be set to a typical average value, for example, $\epsilon_{cooking\ utensil}=0.5$, and stored in the memory of the control system.

The value of the transmission coefficient of the cooktop panel is known and stored in the memory of the control system. The influence of a change in the transmission coefficient, which may be caused by dirt accumulation on the cooktop panel, is also taken into account by the above-described reflection measurement and the determination of the emissivity $\epsilon_{cooking\ utensil}$ of the cooking utensil or of the bottom of the cooking utensil.

In an embodiment of the present invention, the temperature $T_{cooking\ utensil}$ of the cooking utensil bottom can be determined during the cooking phase from the ratio of the two output signals of the second and third heat sensor units and a correction value from the output signal of the first heat sensor unit.

The heat sensor units can, in principle, be selected within wide suitable limits in terms of type, arrangement, and measuring range. Therefore, it is possible for the first heat sensor unit to detect, for example, only the portion of heat flow that emanates downward from the cooktop panel by thermal conduction, the detection being performed, for example, using a contact temperature sensor. In an embodiment, the heat sensor units, in particular the second and third heat sensor units, are in the form of pyrometers. Moreover, the second and third heat sensor units can be combined into a single ratio pyrometer unit.

In an embodiment of the present invention, high measurement accuracy can be achieved because the cooktop panel is heated in the region of the measuring spot by the auxiliary heater and because it can be controlled to $T_{desired}$ via the temperature measured by the first heat sensor unit. In this manner, it is ensured that the temperature of the cooktop panel in the region of the measuring spot is maintained at about $T_{desired}$. The value of $T_{desired}$ corresponds to a value which is assumed for the temperature of the cooking utensil or of the cooking zone and which is to be reached upon completion of the heat-up phase. The measuring spot is preferably located at the center of the cooking zone. Alternatively, the measuring spot may be disposed at an off-center position, for example in the peripheral region of the cooking zone.

The auxiliary heater is mounted to the cooktop in the region of the measuring spot in thermally conductive contact with the lower surface of the cooktop panel for direct heating thereof. Thus, the transfer of heat from the auxiliary heater to the cooktop panel is improved, so that the heat-up phase is not extended in an undesired manner because of the heating of the cooktop panel to $T_{desired}$ in the region of the measuring spot.

In the region of the measuring spot, the optical path between the cooktop panel and the heat sensor units in the form of pyrometers is delimited from the surroundings by a waveguide, in particular a hollow waveguide. This ensures, firstly, that the thermal radiation emitted from the cooktop panel and the cooking utensil reaches the heat sensor units substantially without losses. Secondly, external interfering radiation is largely screened off, so that it will not affect the measurement results in an undesired manner.

In another embodiment, which is an alternative to the aforementioned embodiment, the optical path between the cooktop panel and the heat sensor units in the form of pyrometers is delimited from the surroundings by a reflective half shell, in particular an Ulbricht sphere, the reflective half shell having apertures for the aforementioned heat sensor units. Compared to the aforementioned embodiment, the multiple reflection of the thermal radiation emitted downward by the cooktop panel and the bottom of the cooking utensil toward the aforementioned heat sensor units is further enhanced, so that the input signals of the heat sensor units are amplified, resulting in improved signal quality.

FIG. 1 shows an embodiment of a cooktop according to the present invention. The cooktop includes a cooktop panel 1 which is in the form of a glass-ceramic panel and has a material thickness s defined by a flat upper surface 1.1 and a flat lower surface 1.2 in a direction perpendicular to the main directions of extension of the cooktop panel, and which further includes at least one cooking zone 2 which can be heated by an induction heating device 3 that is located beneath cooktop panel 1 when the cooktop is in the installed position. In this embodiment, the cooktop has a total of four cooking zones 2, of which only one cooking zone 2 is shown and described in the drawing. However, the following explanations apply equally to the other cooking zones 2 of the cooktop. Located beneath cooktop panel 1 is a sensor assembly 4 including first, second and third heat sensor units 4.1, 4.2, 4.3, each of which is in the form of a pyrometer here. Second and third heat sensor units 4.2, 4.3 together form a ratio pyrometer. Sensor assembly 4 is disposed beneath cooktop panel 1, preferably at the center of cooking zone 2. This region is referred to as measuring spot 5. Sensor assembly 4 and, respectively, the measuring spot, may also be disposed at an off-center position, for example in the peripheral region of the cooking zone.

First heat sensor unit 4.1 is designed to measure the heat flow emanating downward substantially only from cooktop panel 1 in the area of cooking zone 2, while second and third heat sensor units 4.2, 4.3 are each designed to measure the heat flow emanating downward substantially from cooktop panel 1 and a cooking utensil 6 placed thereon, in the area of cooking zone 2, which will be explained in greater detail hereinafter. In this embodiment, the measuring range of first heat sensor unit 4.1 is limited to the measurement of thermal radiation in a first wavelength range x, here from about 5 to about 6 μm. The measuring ranges of second and third heat sensor units 4.2, 4.3 are limited to the measurement of thermal radiation in a second and third wavelength ranges y and z, here from about 3 μm to about 3.6 μm and from about 3.7 μm to about 4.2 μm. It is beneficial for the operation of the ratio pyrometer including heat sensor units 4.2 and 4.3 that second and third wavelength ranges y and z are different from each other but, at the same time, are close to each other. Moreover, the two wavelength ranges y and z should be large enough so that the input signals of heat sensor units 4.2 and 4.3 are of sufficient magnitude for further processing. Therefore, the two wavelength ranges y and z cover not only wavelengths for which cooktop panel 1 has the highest possible levels of transmittance, as is clearly discernible from FIG. 2, which will be described in greater detail below.

If, in a departure from the aforementioned embodiment, a cooktop panel 1 is used that is inhomogeneous with respect to transmittance, it is sufficient that in the area of cooking zone 2, cooktop panel 1 has as low a transmittance as possible for thermal radiation at least in the sensing range of first heat sensor unit 4.1 and as high a transmittance as possible for thermal radiation in the sensing ranges of second and third heat sensor units 4.2, 4.3.

The heat sensor units 4.1 through 4.3 of sensor assembly 4, as well as induction heating device 3, are connected in signal communication with an electrical control system 7 including a processing unit 7.1 and a memory 7.2. The signal connection is symbolized by a dashed double-headed arrow 8 in FIG. 1.

In order to allow the heat output of heating device 3 of the cooktop to be controlled accurately, it is beneficial to determine the temperature of cooking utensil 6 placed on cooking zone 2, which will be explained in greater detail below. However, since the thermal radiation of cooking utensil bottom 6.1 also depends on the emissivity $\epsilon_{cooking\ utensil}$ thereof, the emissivity $\epsilon_{cooking\ utensil}$ of cooking utensil bottom 6.1, should also be specified and stored in memory 7.2, or measured during the cooking process, and made available for processing in processing unit 7.1. In principle, it is possible to use an additional heat sensor unit for this purpose. As an alternative, the present embodiment uses second heat sensor unit 4.2 for this purpose. To this end, the cooktop further includes a light source 9. The determination of the emissivity $\epsilon_{cooking\ utensil}$ of cooking utensil 6 placed on cooking zone 2, or of the bottom 6.1 of said cooking utensil, can be carried out by means of a reflection measurement.

In order to reduce the influence that direct and indirect interfering radiation has on the output signals of heat sensor units 4.1 through 4.3 and, at the same time, to amplify the thermal radiation to heat sensor units 4.1 through 4.3 by means of multiple reflection, the cooktop includes a waveguide 10 in the form of a hollow waveguide which is provided on the inside with a coating, such as a gold film, which reflects the thermal radiation. The optical path between cooktop panel 1 and heat sensor units 4.1 through 4.3, which are in the form of pyrometers, is delimited from the surroundings by said (hollow) waveguide 10. In FIG. 1, the thermal radiation emitted by cooktop panel 1 and cooking utensil 6 is symbolized by arrows. This representation is schematic only, because in reality the optical path is much more complex because of the occurrence of multiple reflections.

An auxiliary heater 11, such as a resistance heating element, is disposed in the region of measuring spot 5. Auxiliary heater 11 is mounted directly to the lower surface 1.2 of cooktop panel 1 to provide thermally conductive contact therewith. Thus, the direct heating of cooktop panel 1 in the region of measuring spot 5 by auxiliary heater 11 is implemented in a particularly effective manner. To allow control of auxiliary heater 11, the auxiliary heater is also connected in signal communication with electrical control system 7. Auxiliary heater 11 may be an annular component surrounding the region of measuring spot 5 (see FIG. 1). It is also possible for the auxiliary heater to be arranged within measuring spot 5.

Figure 2:
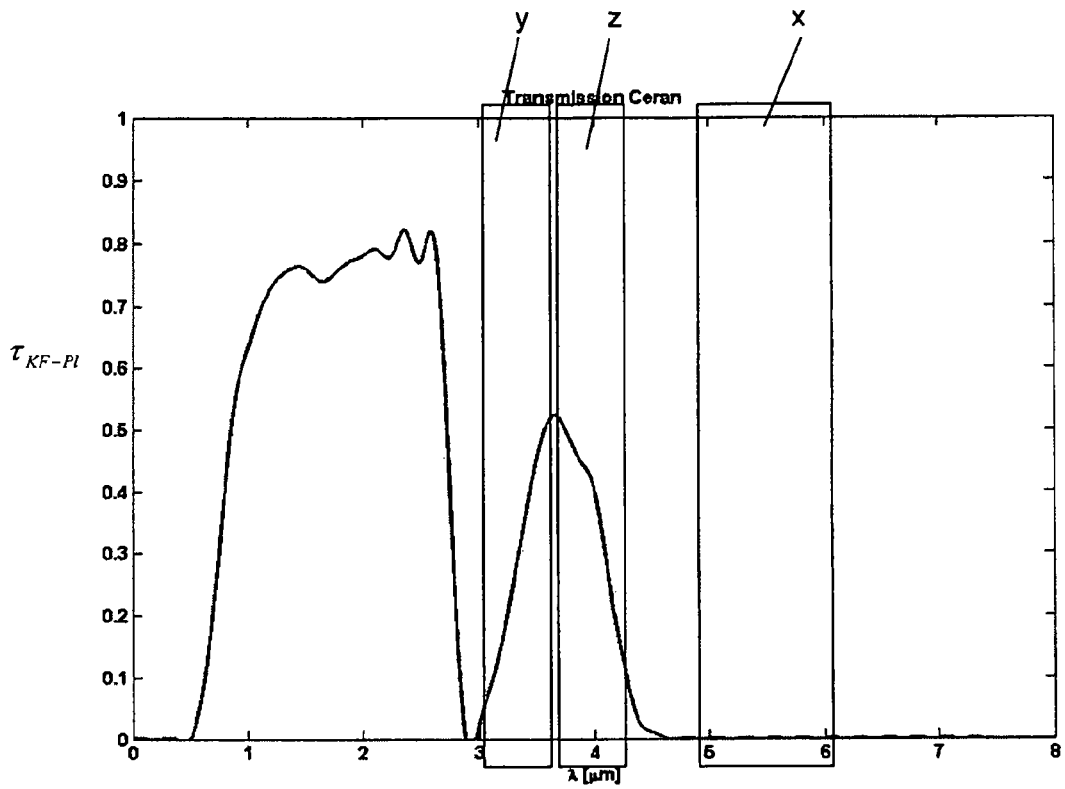
FIG. 2 is a graph showing the transmittance $\tau_{KF\text{-}PI}$ of a cooktop panel of the cooktop of FIG. 1 as a function of the wavelength $\lambda$ of the electromagnetic radiation.

FIG. 2 shows a graph in which the transmittance $\tau_{cooktop\ panel}$, abbreviated $\tau_{KF\text{-}PI}$, of a cooktop panel according to an embodiment of the present invention is shown as a function of the wavelength λ of the electromagnetic radiation, using the example of cooktop panel 1 of this embodiment, which is in the form of a glass-ceramic panel. As already explained with reference to FIG. 1, the measuring ranges of heat sensor units 4.1 through 4.3 are matched to the transmittance $\tau_{cooktop\ panel}$ of the cooktop panel 1 in such a way that the measuring range of first heat sensor unit 4.1 is limited to a first wavelength range x for which cooktop panel 1 has a transmittance of less than 20%, particularly approximately 0%. The measuring ranges of second and third heat sensor units 4.2, 4.3 are limited to second and third wavelength ranges y and z, for which cooktop panel 1 has high levels of transmittance $\tau_{cooktop\ panel}$ and, at the same time, meets the above-described conditions for the use of a ratio pyrometer.

A method in accordance with an embodiment of the present invention will now be described in greater detail with reference to FIGS. 1 through 4.

In processing unit 7.1, a ratio is calculated either continuously or at predetermined time intervals, from the output signals of the two heat sensor units 4.2, 4.3. In order to improve the accuracy of the heat output control in the cooktop, the emissivity $\epsilon_{cooking\ utensil}$ of cooking utensil 6, or of the bottom 6.1 thereof, is taken into account.

Therefore, the ratio calculated from the output signals of heat sensor units 4.2, 4.3 is further processed in processing unit 7.1 as follows:

Thermal radiation M received by heat sensor units 4.2, 4.3; i.e., by the ratio pyrometer, is composed of three radiation components, namely a component a, the thermal radiation of cooktop panel 1, a component b, the thermal radiation from cooking utensil bottom 6.1, and a component c, the thermal radiation from cooktop panel 1 that is reflected by cooking utensil bottom 6.1 and transmitted through cooktop panel 1 toward heat sensor units 4.2, 4.3.

Accordingly, the ratio is calculated as follows:

$$V = \frac{M_{4.2}}{M_{4.3}} = \frac{M_{4.2}^{componenta} + M_{4.2}^{componentb} + M_{4.2}^{componentc}}{M_{4.3}^{componenta} + M_{4.3}^{componentb} + M_{4.3}^{componentc}} \quad (1)$$

where V=ratio, M=specific thermal radiation.

The dependences of the individual radiation components on the temperature $T_{cooktop\ panel}$ of cooktop panel 1, the emissivity $\epsilon_{cooking\ utensil}$ of cooking utensil bottom 6.1 and the emissivity $\epsilon_{cooktop\ panel}$ and transmittance $\tau_{cooktop\ panel}$ of cooktop panel 1 can be seen from the following equation, where F generally denotes a mathematical function.

$$V = \frac{F_{4.2}^{componenta}(\varepsilon_{KF-PI}, T_{KF-PI}) + F_{4.2}^{componentb}(\varepsilon_{KG}, T_{KG}, \tau_{KF-PI}) + F_{4.2}^{componentc}(\varepsilon_{KF-PI}, T_{KF-PI}, \varepsilon_{KG}, \tau_{KF-PI})}{F_{4.3}^{componenta}(\varepsilon_{KF-PI}, T_{KF-PI}) + F_{4.3}^{componentb}(\varepsilon_{KG}, T_{KG}, \tau_{KF-PI}) + F_{4.3}^{componentc}(\varepsilon_{KF-PI}, T_{KF-PI}, \varepsilon_{KG}, \tau_{KF-PI})} \quad (2)$$

In the equation, the subscripts are abbreviated for the sake of clarity, namely cooking utensil as KG and cooktop panel as KF-PI. It should be noted here that the reflectance for component c is equal to 1-emissivity, because the transmittance of the cooking utensil bottom can be approximately equated to 0.

Rewriting equation (2), one obtains:

$$V = \frac{\varepsilon_{KF-PI} \cdot F_{4.2}^{*component\ a}(T_{KF-PI}) + \varepsilon_{KG} \cdot \tau_{KF-PI} \cdot F_{4.2}^{*component\ b}(T_{KG}) + F_{4.2}^{component\ c}(\varepsilon_{KF-PI}, T_{KF-PI}, \varepsilon_{KG}, \tau_{KF-PI})}{\varepsilon_{KF-PI} \cdot F_{4.3}^{*component\ a}(T_{KF-PI}) + \varepsilon_{KG} \cdot \tau_{KF-PI} \cdot F_{4.3}^{*component\ b}(T_{KG}) + F_{4.3}^{component\ c}(\varepsilon_{KF-PI}, T_{KF-PI}, \varepsilon_{KG}, \tau_{KF-PI})} \quad (3)$$

where F*=the function that is changed because the multiplicative factors have been factored out. It should be noted here that, because of the occurrence of multiple reflections, $\epsilon_{cooking\ utensil}$, $\epsilon_{cooktop\ panel}$ and $\tau_{cooktop\ panel}$ cannot be factored out of the brackets of the function $F^{component\ c}$ for the two heat sensor units 4.2 and 4.3 (subscripts 4.2 and 4.3), which is dependent on component c.

The emissivity $\epsilon_{cooktop\ panel}$ and transmittance $\tau_{cooktop\ panel}$ of cooktop panel 1 are known and stored in memory 7.2 for the further processing of comparison value V. Temperature $T_{cooktop\ panel}$ of cooktop panel 1 is measured by heat sensor unit 4.1 during the cooking process, either continuously or at predetermined time intervals, and is thus also available for the further processing of comparison value V.

The same applies to the emissivity $\epsilon_{cooking\ utensil}$ of cooking utensil bottom 6.1, which is determined as described above. Thus, the only remaining unknown is the temperature $T_{cooking\ utensil}$ of cooking utensil bottom 6.1 and can thus be calculated.

Figure 3:
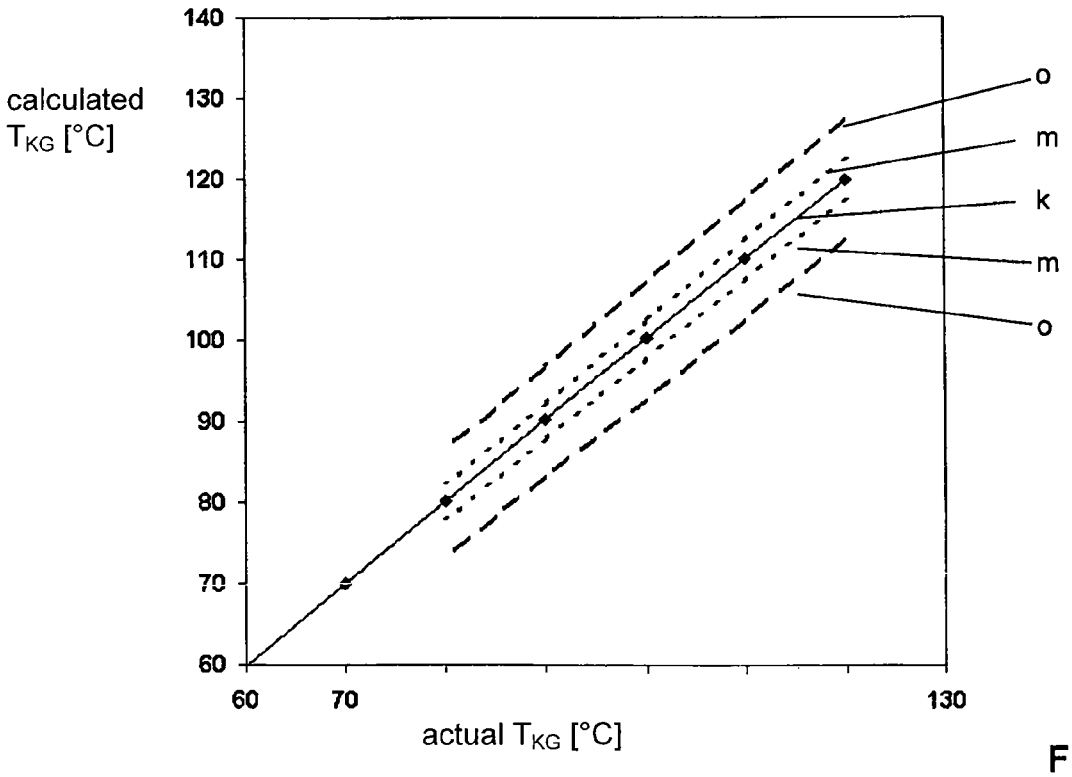
FIG. 3 is a graph illustrating the correlation between the calculated and the actual temperature $T_{KG}$ of the cooking utensil bottom.

In the case of a clean cooktop panel 1; i.e., when no dirt is present on upper surface 1.1., the obtained relationship between the calculated and the actual temperature $T_{cooking\ utensil}$ of the cooking utensil bottom is that which is represented by line k in FIG. 3. The two temperatures are substantially equal. When upper surface 1.1 is dirty, which is a common occurrence during use, the value of emissivity $\epsilon_{cooking\ utensil}$ of cooking utensil bottom 6.1, which is determined by the above-described known reflection measurement, is corrupted because of the variations in the properties of cooktop panel 1, namely emissivity $\epsilon_{cooking\ utensil}$ and transmittance $\tau_{cooktop\ panel}$, and, therefore, said value no longer corresponds to the actual value. Therefore, for most application cases; i.e., when upper surface 1.1 of cooktop panel 1 is dirty in the area of cooking zone 2, the calculated value of the temperature $T_{cooking\ utensil}$ of the cooking utensil bottom exhibits a certain spread. In this regard, see lines m, which delimit the spread. The influence of a corrupted value for the emissivity of cooking utensil bottom 6.1, is minimized by heating the cooktop panel in the region of the measuring spot. Therefore, the differences between the calculated value and the actual value of the temperature $T_{cooking\ utensil}$ of the cooking utensil bottom is within an acceptable range, which permits high-quality, highly reproducible control of the heat output of heating device 3 of the cooktop.

In another embodiment of the present invention, in which the emissivity $\epsilon_{cooking\ utensil}$ of cooking utensil bottom 6.1 is not determined automatically, this emissivity is specified in advance, stored, and used for the further processing of ratio V, analogously to the emissivity $\epsilon_{cooktop\ panel}$ and transmittance $\tau_{cooktop\ panel}$ of cooktop panel 1. To this end, an average emissivity $\epsilon_{cooking\ utensil}$ of cooking utensil bottom 6.1 of, for example, 0.5 is chosen. Thus, the deviations for cooking utensils having a higher or lower emissivity $\epsilon_{cooking\ utensil}$ are not excessive. In this regard, see FIG. 3 where this is illustrated by lines o.

The following further embodiments and alternatives to the embodiment mentioned above will be explained only to the extent that they differ from the above-described embodiment.

Figure 4:
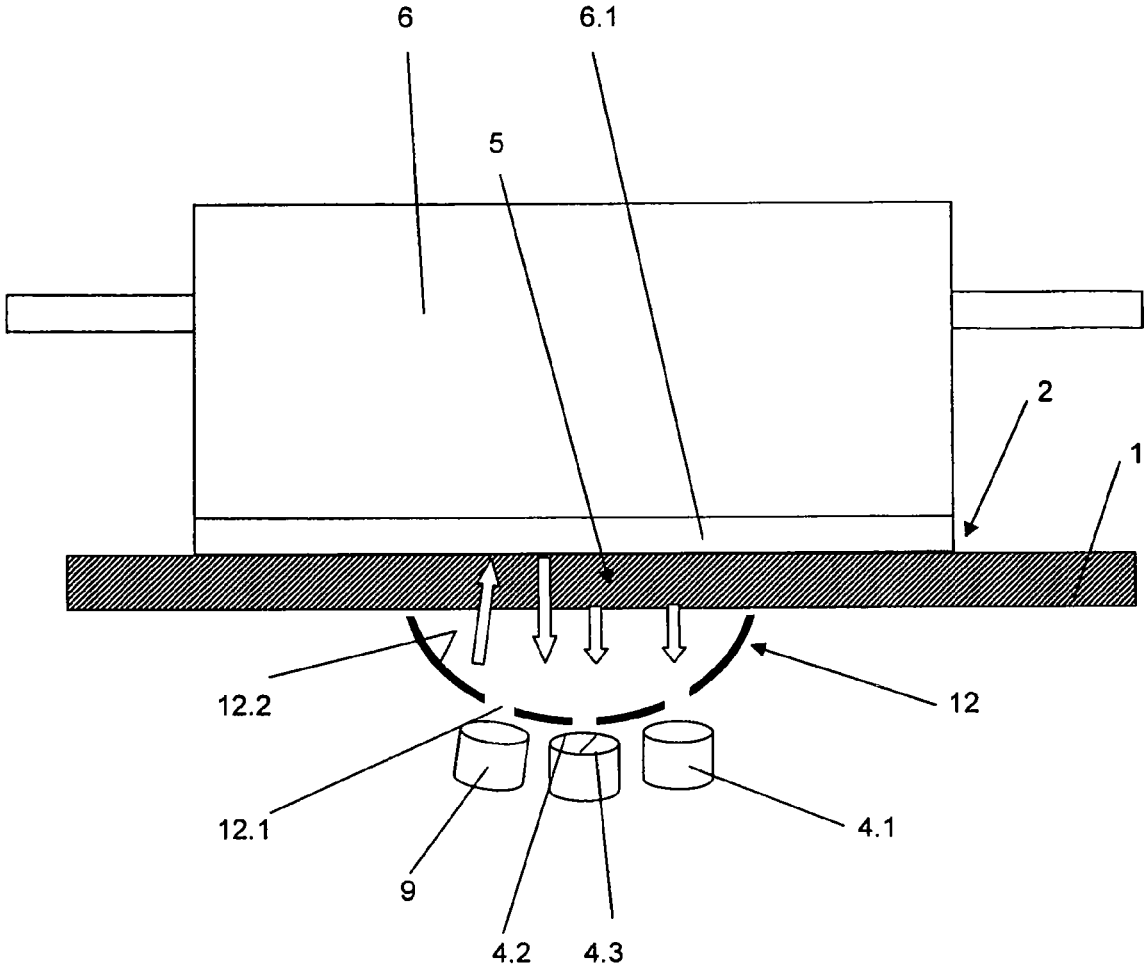
FIG. 4 is a view similar to FIG. 1 of another embodiment of a cooktop according to the present invention.

FIG. 4 shows another embodiment, in which a reflective half shell 12 in the form of an Ulbricht sphere is used in place of hollow waveguide 10. For the sake of clarity, the area of sensor assembly 4 is shown substantially enlarged. Reflective half shell 12 has openings 12.1, so that the optical path between cooktop panel 1 and cooking utensil bottom 6.1 and heat sensor units 4.1 through 4.3 as well as light source 9 is not blocked in an undesired manner. The Ulbricht sphere 12 used has an inner surface 12.2 of high reflectance. As an alternative to Ulbricht sphere 12, other suitable forms of a reflective half shell known to those skilled in the art, such as a paraboloidal section, may also be used.

In the cooktop panel of the above-described design, induction heating device 3 heats cooking utensil 6 to the desired temperature during the heat-up phase. In the region of measuring spot 5 of cooking zone 2, cooktop panel 1 is heated by auxiliary heater 11 to $T_{desired}$. The value of $T_{desired}$ corresponds to a value which is assumed for the temperature of the cooking utensil which is to be reached upon completion of the heat-up phase. Monitoring of $T_{desired}$ is via heat sensor 4.1. As a result of the heating by means of induction heating device 3, the temperature at the bottom of cooking utensil 6 reaches a value approximately equal to $T_{desired}$. Thus, using this method, cooktop panel 1, in the region of measuring spot 5, is heated to and maintained at a temperature approximately equal to that for cooking utensil 6. Because of this, cooktop panel 1 and cooking utensil 6 can in good approximation be treated as a single radiant body from a measurement standpoint.

Because of this, the ratio-pyrometer-based temperature measurement can be used in the cooktop with high measurement accuracy because the emissivity of the cooking utensil determined by reflection measurement is also taken into account in the calculation of the temperature of cooking utensil bottom 6.1. Thus, during a cooking phase which follows the heat-up phase and during which $T_{desired}$ is maintained substantially constant for both cooking utensil 6 and cooktop panel 1 by temperature control actions, the temperature $T_{cooking\ utensil}$ of cooking utensil bottom 6.1 can be determined from the above-mentioned ratio V.

Rewriting equation (1), one obtains:

$$T_{KG} = f\left(\frac{M_{4.2}}{M_{4.3}}\right) \tag{2}$$

where $T_{cooking\ utensil}$=temperature of cooking utensil bottom 6.1 and f=general abbreviation for a function. In the equation, the subscript is abbreviated for the sake of clarity, namely cooking utensil as KG.

After reaching $T_{cooking\ utensil}$ for cooking zone 2 and $T_{desired}$ in the region of measuring spot 5, the temperature $T_{cooking\ utensil}$ of the cooking utensil bottom is determined in a cooking phase following the heat-up phase, such as a phase of continued cooking, only based on the output signals of second and third heat sensor units 4.2 and 4.3. This is possible provided the temperature in the region of measuring spot 5 is maintained at a constant value $T_{desired}$. In the process, the instantaneous ratio V is compared to predetermined reference values stored in memory 7.2 for different temperatures $T_{desired}$ for cooking utensil 6. If the instantaneous ratio V is less than the reference value stored for $T_{desired}$; i.e., the temperature of the cooking utensil is too low, then cooking utensil 6 is further heated by induction heating device 3 until $T_{KG}=T_{desired}$. Such a case may occur, for example, when the user adds additional cold water to cooking utensil 6 during a cooking process. If the instantaneous ratio V is greater than the reference value; i.e., the temperature of the cooking utensil is too high, then the heat output of induction heating device 3 is reduced accordingly. During this process, cooktop panel 1 is maintained at $T_{desired}$ in the region of measuring spot 5. Instead of recording desired values $T_{desired}$ for the temperature of cooktop panel 1/of cooking utensil 6 and reference values in a table and storing them, it is also conceivable to store a mathematical formula.

The cooktop of the present invention and the method of the present invention for controlling a cooktop can be embodied and applied in a wide variety of ways. For example, it is possible to conceive of many cooktop functions where the temperature of the cooking utensil and/or the control thereof is necessary or advantageous. For example, a boil-over protection feature may be implemented which effectively prevents boiling over by the aforementioned control. The same applies to maintaining an optimum frying temperature that is matched to the particular foodstuff to be cooked. The cooking or frying process can be started at the push of a button. When the point is reached at which cooking begins, or when the desired pan temperature is reached, the user is informed accordingly by audible and/or visual signals and can thus turn his/her attention to other household tasks while the cooking or frying process continues. Furthermore, knowing the temperature of the cooking utensil or quantities which are dependent on this temperature, such as its gradient or its time profile, the heat-up and cooking times can be reduced while at the same time providing improved protection of the cooktop panel against overheating. This ensures, for example, that no damage will occur to the cooktop panel or any adjacent kitchen furniture, or to the cooking utensil itself. This could happen if the cooking utensil is empty or has boiled dry, or if fat in the pan is excessively heated. This makes it possible to implement what is known as "speed cook feature"; i.e., to provide the possibility of adapting the heat output to the particular cooking utensil and the load contained therein, such as a piece of meat or water to be boiled, during the heat-up phase. When using a cooking utensil which absorbs heat to a lesser extent and/or contains a large load, then, during the heat-up phase, the cooking zone will automatically be heated with a higher average heat output than is the case when using a cooking utensil that absorbs heat better and/or contains a smaller load. Also, because the heat output of the cooking utensil heating means; i.e., of the heating device, is controlled directly as a function of the temperature of the cooking utensil, the protection against boiling dry, boiling over, or the like, can be improved by providing an automatic safety cut-out in response to the cooking utensil reaching a predetermined shut-off temperature. The direct dependence on the temperature of the cooking utensil provides the required safety without causing the heat output to be prematurely and thus unnecessarily reduced in the case of certain cooking utensils, such as ones that efficiently absorb heat. This allows the heat-up phase to be shortened without affecting safety in an undesired manner.

Furthermore, it is possible to implement what is known as "temperature-hold feature", which allows the user to cause the instantaneous temperature of the cooking utensil to be automatically maintained for the further cooking or frying process at the push of a button or in another way. The same applies to what is known as "keep warm feature", which causes the average heat output of a particular cooking zone to be automatically reduced to a predetermined value in response to an input from the user. Alternatively, it would be possible to automatically reduce the temperature of the cooking utensil to a predetermined lower value, for example, to 30° C. This has the advantage over commercial approaches in that, for the control of the heat output, it is not the temperature of the lower cooktop panel surface that is used, but, instead, the temperature of the cooking utensil bottom. This allows the generally known temperature-hold and keep warm features to be improved in terms of the response time of the control, for example, when the load is changed by adding cold water to the cooking utensil or by placing a large piece of meat in the cooking utensil. Due to the great variety of possible applications, the desired temperatures $T_{desired}$ for the cooktop panel and the cooking utensil may also vary greatly as well.

While the invention has been particularly shown and described with reference to preferred embodiments thereof, it will be understood by those skilled in the art that various changes in form and details may be made therein without departing from the spirit and scope of the invention

What is claimed is:

1. A method for controlling a cooktop having a cooktop panel, the method comprising:

providing the cooktop with at least one cooking zone that is heatable by an induction heating device disposed below the cooktop panel when the cooktop is in an installed position;

providing an electrical control system including a processing unit and a memory;

providing first, second and third heat sensor units beneath the cooktop panel in a region of a measuring spot, the first heat sensor unit being configured to measure heat flow emanating downward from substantially only the cooktop panel in an area of the at least one cooking zone, the second and third heat sensor units being configured to measure heat flow emanating downward in an area of the cooking zone from the cooktop panel and a cooking utensil disposed on the cooktop panel;

performing a reflection measurement to determine an emissivity $\epsilon_{cooking\ utensil}$ of a bottom of the cooking utensil using at least one emissivity heat sensor and a light source;

heating the cooking utensil using the induction heating device during a heat-up phase;

heating the cooktop panel in an area of the cooking zone to a predetermined desired temperature $T_{cooking\ utensil}$ during the heat-up phase;

storing a value for the emissivity $\epsilon_{cooking\ utensil}$ of the bottom of the cooking utensil in the memory of the electrical control system;

heating the region of the measuring spot using an auxiliary heater to a temperature $T_{desired}$, $T_{desired}$ being at least approximately equal to the predetermined desired temperature $T_{cooking\ utensil}$;

upon reaching $T_{desired}$ at the measuring spot and $T_{cooking\ utensil}$ at the cooking zone, calculating, in a cooking phase following the heat-up phase, a ratio from output signals of the second and third heat sensor units using the electrical control system;

determining an actual temperature of the bottom of the cooking utensil from the ratio by using a temperature of a lower surface of the cooktop panel $T_{cooktop\ panel}$ measured by the first sensor unit and the value of the emissivity $\epsilon_{cooking\ utensil}$ of the bottom of the cooking utensil; and controlling the induction heating device as a function of the actual temperature of the bottom of the cooking utensil.

2. The method as recited in claim 1, wherein the cooktop panel comprises glass-ceramic.

3. A cooktop comprising:

a cooktop panel having a material thickness in a direction perpendicular to main directions of extension of the cooktop panel, the material thickness being defined by a flat upper surface and a flat lower surface of the cooktop panel;

at least one cooking zone;

an induction heating device disposed below the cooktop panel in an installed position of the cooktop panel and operable to heat the at least one cooking zone;

first, second and third heat sensor units disposed beneath the cooktop panel in a region of a measuring spot, the first heat sensor unit being configured to measure heat flow emanating downward from substantially only the cooktop panel in an area of the at least one cooking zone, the second and third heat sensor units being configured to measure heat flow emanating downward in an area of the cooking zone from the cooktop panel and a cooking utensil disposed on the cooktop panel;

a light source operable, in combination with at least one emissivity heat sensor, to measure an emissivity $\epsilon_{cooking\ utensil}$ of a bottom of a cooking utensil disposed on the cooktop panel;

an auxiliary heater operable to heat a region of the measuring spot to a temperature approximately equal to a temperature of the cooking zone; and an electrical control system including a processing unit and a memory, the electrical control system configured to:

calculate a ratio from output signals of the second and third heat sensor units during a cooking phase, determine an actual temperature of the bottom of the cooking utensil from the ratio by using a temperature of a lower surface of the cooktop panel $T_{cooktop\ panel}$ measured by the first sensor unit and a value, stored in the memory, of the emissivity $\epsilon_{cooking\ utensil}$ of the bottom of the cooking utensil, control the induction heating device as a function of the actual temperature of the bottom of the cooking utensil, and control a heat output of the auxiliary heater.

4. The cooktop recited in claim 3, wherein the cooktop panel comprises glass-ceramic.

5. The cooktop recited in claim 3 wherein the auxiliary heater is disposed in thermally conductive contact with the lower surface of the cooktop panel so as to directly heat the cooktop panel.

6. The cooktop as recited in claim 3, wherein the first, second and third heat sensor units include pyrometers and wherein an optical path between the heat sensor units and the lower surface of the cooktop panel is delimited from its surroundings by a waveguide.

7. The cooktop as recited in claim 6, wherein the waveguide is hollow.

8. The cooktop as recited in claim 6, wherein the reflective half shell is an Ulbricht sphere.

9. The cooktop as recited in claim 3 wherein the light source is disposed so as to illuminate the lower surface of the cooktop panel, and wherein an optical path between the light source and the lower surface of the cooktop panel is delimited from its surroundings by a waveguide.

10. The cooktop as recited in claim 9 wherein the waveguide is hollow.

11. The cooktop as recited in claim 9 wherein the reflective half shell is an Ulbricht sphere.

12. The cooktop as recited in claim 3, wherein the first, second and third heat sensor units include pyrometers and wherein an optical path between the heat sensor units and the lower surface of the cooktop panel is delimited from its surroundings by a reflective half shell, the reflective half shell having apertures for the first, second and third heat sensor units.

13. The cooktop as recited in claim 3 wherein the light source is disposed so as to illuminate the lower surface of the cooktop panel, and wherein an optical path between the light source and the lower surface of the cooktop panel is delimited from its surroundings by a reflective half shell, the reflective half shell having an aperture for the light source.

* * * * *